US006015784A

United States Patent [19]

Kazuta et al.

[11] Patent Number: 6,015,784

[45] Date of Patent: Jan. 18, 2000

[54] SECONDARY ALKYL SULFATE PARTICLES WITH IMPROVED SOLUBILITY BY COMPACTION/COATING PROCESS

[75] Inventors: Takashi Kazuta; Fukuji Ebihara, both of Kobe, Japan

[73] Assignee: The Procter & Gamble Company, Cincinnati, Ohio

[21] Appl. No.: 09/142,460

[22] PCT Filed: Feb. 26, 1997

[86] PCT No.: PCT/US97/03079

§ 371 Date: Mar. 10, 1999

§ 102(e) Date: Mar. 10, 1999

[87] PCT Pub. No.: WO97/32951

PCT Pub. Date: Sep. 12, 1997

Related U.S. Application Data

[60] Provisional application No. 60/013,311, Mar. 8, 1996.

[51] Int. Cl.[7] ..... C11D 11/00; C11D 1/14

[52] U.S. Cl. ..... 510/446; 510/349; 510/351; 510/357; 510/361; 510/441; 510/477; 510/495; 510/507; 510/511; 264/118; 264/140

[58] Field of Search ..... 510/446, 441, 510/349, 351, 357, 361, 477, 495, 507, 511, 118, 140

[56] References Cited

U.S. PATENT DOCUMENTS

| | | | |
|---|---|---|---|
| 5,389,277 | 2/1995 | Prieto | 252/99 |
| 5,489,392 | 2/1996 | Capeci et al. | 252/89.1 |

FOREIGN PATENT DOCUMENTS

| | | | |
|---|---|---|---|
| 2289687 | 11/1995 | United Kingdom | C11D 3/04 |
| 94/24241 | 10/1994 | WIPO . | |
| WO 94/24242 | 10/1994 | WIPO | C11D 1/14 |
| WO 95/14072 | 5/1995 | WIPO | C11D 1/83 |

*Primary Examiner*—Lorna M. Douyon
*Attorney, Agent, or Firm*—Ian S. Robinson; C. Brant Cook; Kim W. Zerby

[57] ABSTRACT

Secondary (2,3) alkyl sulfate surfactants are admixed with an organic material such as a polyacrylate, and the resulting mixture is compacted into chips. The chips are comminuted to provide particles and the particles are coated with a free-flow aid. The resulting particles exhibit improved solubility and are especially useful in laundry detergents.

8 Claims, No Drawings

SECONDARY ALKYL SULFATE PARTICLES WITH IMPROVED SOLUBILITY BY COMPACTION/COATING PROCESS

This application claims the benefit of U.S. Provisional Application No. 60/013,311, filed Mar. 8, 1996.

FIELD OF THE INVENTION

Secondary alkyl sulfate (SAS) surfactants are processed using various ingredients to provide improved water solubility. The resulting SAS particles are useful in laundry detergents and other cleaning compositions, especially under cold water washing conditions.

BACKGROUND OF THE INVENTION

Most conventional detergent compositions contain mixtures of various detersive surfactants in order to remove a wide variety of soils and stains from surfaces. For example, various anionic surfactants, especially the alkyl benzene sulfonates, are useful for removing particulate soils, and various nonionic surfactants, such as the alkyl ethoxylates and alkylphenol ethoxylates, are useful for removing greasy soils. While a review of the literature would seem to suggest that a wide selection of surfactants is available to the detergent manufacturer, the reality is that many such materials are specialty chemicals which are not suitable for routine use in low unit cost items such as home laundering compositions. The fact remains that many home-use laundry detergents still comprise one or more of the conventional alkyl benzene sulfonate or primary alkyl sulfate surfactants.

One class of surfactants which has found limited use in various compositions where emulsification is desired comprises the secondary allyl sulfates. The conventional secondary alkyl sulfates are available as generally pasty, random mixtures of sulfated linear and/or partially branched alkanes. Such materials have not come into widespread use in laundry detergents, since they offer no particular advantages over the alkyl benzene sulfonates.

Modern granular laundry detergents are being formulated in "condensed" form which offers substantial advantages, both to the consumer and to the manufacturer. For the consumer, the smaller package size attendant with condensed products provides ease-of-handling and storage. For the manufacturer, unit storage costs, shipping costs and packaging costs are lowered.

The manufacture of acceptable condensed granular detergents is not without its difficulties. In a typical condensed formulation, the so-called "inert" ingredients such as sodium sulfate are mainly deleted. However, such ingredients do play a role in enhancing the solubility of conventional spray-dried detergent; hence, the condensed form will often suffer from solubility problems. Moreover, conventional low-density detergent granules are usually prepared by spray-drying processes which result in porous detergent particles that are quite amenable to being solubilized in aqueous laundry liquors. By contrast, condensed formulations will typically comprise substantially less porous, high density detergent particles which are less amenable to solubilization. Overall, since the condensed form of granular detergents typically comprises particles which contain high levels of detersive ingredients with little room for solubilizing agents, and since such particles are intentionally manufactured at high bulk densities, the net result can be a substantial problem with regard to in-use solubility.

It has now been discovered that a particular sub-set of the class of secondary alkyl sulfates, referred to herein as secondary (2,3) alkyl sulfates ("SAS"), offers considerable advantages to the formulator and user of detergent compositions. For example, the secondary (2,3) alkyl sulfates are available as dry, particulate solids. Accordingly, they prospectively can be formulated as high-surfactant (i.e., "high-active") particles for use in granular laundry detergents. Since, with proper care in manufacturing, the secondary (2,3) alkyl sulfates are available in solid, particulate form, they can be dry-mixed into granular detergent compositions without the need for passage through spray drying towers. In addition to the foregoing advantages seen for the secondary (2,3) alkyl sulfates, it has now been determined that they are both aerobically and anaerobically degradable, which assists in their disposal in the environment. Desirably, the secondary (2,3) alkyl sulfates are quite compatible with detersive enzymes, especially in the presence of calcium ions.

Unfortunately, commercially available SAS particles are somewhat deficient with regard to their rate of solubility in cooler aqueous wash liquors. This problem is especially acute in countries where consumers prefer cold washing temperatures, i.e., as low as about 5° C. This problem is further exacerbated when SAS is used in high density detergent granules.

The present invention converts commercial SAS powder which has a relatively slow dissolution rate into fast-dissolving detergent particles. Importantly, the SAS particles provided herein are free-flowing, and can be readily admixed with other ingredients to provide fully-formulated granular detergents. Accordingly, the present invention overcomes many of the problems associated with the use of SAS in granular laundry detergents or other granular cleaning compositions.

BACKGROUND ART

Detergent compositions with various "secondary" and branched alkyl sulfates are disclosed in various patents; see: U.S. Pat. No. 2,900,346, Fowkes et al, Aug. 18, 1959; U.S. Pat. No. 3,234,258, Morris, Feb. 8, 1966; U.S. Pat. No. 3,468,805, Grifo et al, Sep. 23, 1969; U.S. Pat. No. 3,480,556, DeWitt et al, Nov. 25, 1969; U.S. Pat. No. 3,681,424, Bloch et al, Aug. 1, 1972; U.S. Pat. No. 4,052,342, Fernley et al, Oct. 4, 1977; U.S. Pat. No. 4,079,020, Mills et al, Mar. 14, 1978; U.S. Pat. No. 4,226,797, Bakker et al., Oct. 7, 1980; U.S. Pat. No. 4,235,752, Rossall et al, Nov. 25, 1980; U.S. Pat. No. 4,317,938, Lutz, Mar. 2, 1982; U.S. Pat. No. 4,529,541, Wilms et al, Jul. 16, 1985; U.S. Pat. No. 4,614,612, Reilly et al, Sep. 30, 1986; U.S. Pat. No. 4,880,569, Leng et al, Nov. 14, 1989; U.S. Pat. No. 5,075,041, Lutz, Dec. 24, 1991; U.S. Pat. No. 5,349,101, Lutz et al., Sep. 20, 1994; U.S. Pat. No. 5,389,277, Prieto, Feb. 14, 1995; U.K. 818,367, Bataafsche Petroleum, Aug. 12, 1959; U.K. 858,500, Shell, Jan. 11, 1961; U.K. 965,435, Shell, Jul. 29, 1964; U.K. 1,538,747, Shell, Jan. 24, 1979; U.K. 1,546,127, Shell, May 16, 1979; U.K. 1,550,001, Shell, Aug. 8, 1979; U.K. 1,585,030, Shell, Feb. 18, 1981; GB 2,179,054A, Leng et al, Feb. 25, 1987 (referring to GB 2,155,031). U.S. Pat. No. 3,234,258, Morris, Feb. 8, 1966, relates to the sulfation of alpha olefins using $H_2SO_4$, an olefin reactant and a low boiling, nonionic, organic crystallization medium.

Various means and apparatus suitable for preparing high-density granules have been disclosed in the literature and some have been used in the detergency art. See, for example: U.S. Pat. No. 5,133,924; EP-A-367,339; EP-A-390,251; EP-A-340,013; EP-A-327,963; EP-A-337,330; EP-B-229,671; EP-B2-191,396; JP-A-6,106,990; EP-A-342,043; GB-B-2,221,695; EP-B-240,356; EP-B-242,138; EP-A-242, 141; U.S. Pat. No. 4,846,409; EP-A-420,317; U.S. Pat. No. 2,306,698; EP-A-264,049; U.S. Pat. No. 4,238,199; DE 4,021,476.

See also: WO 94/24238; WO 94/24239; WO 94/24240; WO 94/24241; WO 94/24242; WO 94/24243; WO 94/24244; WO 94/24245; WO 94/24246; U.S. Pat. No. 5,478,500, Swift et al, Dec. 26, 1995; U.S. Pat. No. 5,478,502, Swift, Dec. 26, 1995; U.S. 5,478,503, Dec. 26, 1995.

SUMMARY OF THE INVENTION

The present invention encompasses a process for preparing particles of secondary (2,3) alkyl sulfate surfactants with improved solubility, comprising the steps of:

(a) admixing said secondary (2,3) alkyl sulfate in particulate form with a water-soluble particulate organic material to provide a substantially homogeneous powder mixture containing at least about 10%, by weight, of said secondary (2,3) alkyl sulfate;

(b) compacting said powder mixture from step (a) into chips;

(c) comminuting the chips from step (b) into particles having a size in the range from about 100 to about 2000 micrometers and a density of at least about 500 g/L;

(d) coating said particles from step (c) with a free-flow aid to provide free-flowing particles;

(e) optionally, sizing the coated particles of step (d) to a mean particle size in the preferred range from about 100 to about 1500 micrometers.

In a preferred mode, the homogeneous powder mixture of step (a) comprises from about 10% to about 75%, by weight, of the secondary (2,3) alkyl sulfate surfactant. While various water-soluble organic materials may be used, the preferred organic material used in step (a) is a member selected from the group consisting of polyacrylates, acrylate/maleate copolymers, and mixtures thereof.

In a typical mode, the chips of step (b) have a density in the range from about 1000 g/L to about 1700 g/L. The chips are then comminuted into the particles of step (c) whose density is at least about 500 g/L preferably at least about 550 g/L.

The free-flow aid used in step (d) can be any convenient dry powder, and is preferably a member selected from the group consisting of finely powdered (0.5–10micrometer) zeolite, finely powdered silica, and mixtures thereof The free-flow aid is preferably applied by first coating the particles of step (c) with a nonionic surfactant binder and, thereafter, coating said particles with said free-flow aid. The preferred particles thus produced comprise from about 1% to about 10%, by weight, of the nonionic binder and from about 3% to about 12%, by weight, of the free-flow aid.

The invention also provides fully-formulated granular detergent compositions, comprising conventional formulation ingredients and at least about 5%, by weight, of the particles prepared according to the process herein, more preferably from about 10% to about 99%, by weight, of the particles prepared with the nonionic surfactant plus free-flow aid coating noted above.

All percentages, ratios and proportions herein are by weight, unless otherwise specified. All documents cited are, in relevant part, incorporated herein by reference.

DETAILED DESCRIPTION OF THE INVENTION

The SAS surfactant and its processing in the manner of the present invention are described in detail, hereinafter. Other ingredients which can be used to prepare fully-formulated detergent compositions are also disclosed for the convenience of the formulator, but are not intended to be limiting thereof

Secondary (2,3) Alkyl Sulfate Surfactant

The soluble particles provided by the process herein preferably contain from about 10% to about 70%, more preferably from about 20% to about 60%, and most preferably from about 30% to about 50% of a secondary (2,3) alkyl sulfate surfactant as described herein. For the convenience of those skilled in the art, the following discussion of the secondary (2,3) alkyl sulfates used herein serves to distinguish these materials from conventional alkyl sulfate ("AS") surfactants.

The discovery that SAS powder can be processed by various grinding and coating techniques is very surprising and unexpected, and suggests that this is unique for SAS. SAS powder is highly crystalline, and thus very friable and easily broken into fine dust without undue stickiness/reagglomeration. Once treated in the manner of this invention, this fine dust of SAS can be dispersed in water to give faster dissolution due to the increased surface area.

In contrast, normal surfactants, due to impurities and chain length mixtures, are not friable enough to be easily broken, and do not lend to such processing methods. The conventional AS surfactants constitute one such example. Although pure AS is highly crystalline, the commercial grade of AS is present as AS crystals dispersed in a waxy medium of impurities. Grinding is not possible at normal temperatures. Since the AS crystals have larger particle sizes than the ground SAS, AS also does not disperse as well in water, and AS particles suffer from a relatively slower dissolution rate.

Conventional primary alkyl sulfate surfactants have the general formula $$ROSO_3^-M^+$$

wherein R is typically a linear $C_{10}$–$C_{20}$ hydrocarbyl group and M is a water-solubilizing cation. Branched-chain primary alkyl sulfate surfactants i.e., branched-chain "PAS") having 10–20 carbon atoms are also known; see, for example, European Patent Application 439,316, Smith et al, filed Jan. 21, 1991.

Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 or greater and the sum of m+n is typically about 9 to 17, and M is a water-solubilizing cation.

By contrast with the above, the selected secondary (2,3) alkyl sulfate surfactants used herein comprise structures of formulas A and B $$CH_3(CH_2)_x(CHOSO_3^{-M+})\ CH_3 \text{ and} \quad (A)$$

$$CH_3(CH_2)_y(CHOSO_3^{-M+})CH_2CH_3 \quad (B)$$

for the 2-sulfate and 3-sulfate, respectively. Mixtures of the 2- and 3-sulfate can be used herein. In formulas A and B, x and (y+1) are, respectively, integers of at least about 6, and can range from about 7 to about 20, preferably about 10 to about 16.

M is a cation, such as an alkali metal, ammonium, alkanolammonium, alkaline earth metal, or the like. Sodium is typical for use as M to prepare the water-soluble secondary (2,3) alkyl sulfates, but ethanolammonium, diethanolammonium, triethanolammonium, potassium, ammonium, and the like, can also be used.

Materials A and B, and mixtures thereof, are abbreviated "SAS", herein.

By the present invention, it has been determined that the physical/chemical properties of the foregoing types of alkyl sulfate surfactants are unexpectedly different, one from another, in several aspects which are important to formulators of various types of detergent compositions. For example, the primary alkyl sulfates can disadvantageously interact with, and even be precipitated by, metal cations such as calcium and magnesium. Thus, water hardness can negatively affect the primary alkyl sulfates to a greater extent than SAS. Accordingly, the SAS has now been found to be preferred for use in the presence of calcium ions and under conditions of high water hardness, or in the so-called "under-built" situation which can occur when nonphosphate builders are employed.

With regard to the random secondary alkyl sulfates (i.e., secondary alkyl sulfates with the sulfate group at positions such as the 4, 5, 6, 7, etc. secondary carbon atoms), such materials tend to be tacky solids or, more generally, pastes. Thus, the random alkyl sulfates do not afford the processing advantages associated with the solid SAS when formulating detergent granules. Moreover, SAS provides better sudsing than the random mixtures. It is preferred that SAS be substantially free (i.e., contain less than about 20%, more preferably less than about 10%, most preferably less than about 5%) of such random secondary alkyl sulfates.

One additional advantage of the SAS surfactants herein over other positional or "random" alkyl sulfate isomers is in regard to the improved benefits afforded by said SAS with respect to soil redeposition in the context of fabric laundering operations. As is well-known to users, laundry detergents loosen soils from fabrics being washed and suspend the soils in the aqueous laundry liquor. However, as is well-known to detergent formulators, some portion of the suspended soil can be redeposited back onto the fabrics. Thus, some redistribution and redeposition of the soil onto all fabrics in the load being washed can occur. This, of course, is undesirable and can lead to the phenomenon known as fabric "graying". (As a simple test of the redeposition characteristics of any given laundry detergent formulation, unsoiled white "tracer" cloths can be included with the soiled fabrics being laundered. At the end of the laundering operation the extent to which the white tracers deviate from their initial degree of whiteness can be measured photometrically or estimated visually by skilled observers. The more the tracers' whiteness is retained, the less soil redeposition has occurred.)

It has also been determined that SAS affords substantial advantages in soil redeposition characteristics over the other positional isomers of secondary alkyl sulfates in laundry detergents, as measured by the cloth tracer method noted above. Thus, the selection of SAS surfactants according to the practice of this invention which preferably are substantially free of other positional secondary isomers unexpectedly assists in solving the problem of soil redeposition in a manner not heretofore recognized.

It is to be noted that the SAS used herein is quite different in several important properties from the secondary olefin sulfonates (e.g., U.S. Pat. No. 4,064,076, Klisch et al, Dec. 20, 1977); accordingly, such secondary sulfonates are not the focus of the present invention.

The preparation of SAS of the type useful herein can be carried out by the addition of $H_2SO_4$ to olefins. A typical synthesis using α-olefins and sulfuric acid is disclosed in U.S. Pat. No. 3,234,258, Morris, or in U.S. Pat. No. 5,075,041, Lutz, granted Dec. 24, 1991, both of which are incorporated herein by reference. The synthesis, conducted in solvents which afford the SAS on cooling, yields products which, when purified to remove the unreacted materials, randomly sulfated materials, unsulfated by-products such as $C_{10}$ and higher alcohols, secondary olefin sulfonates, and the like, are typically 90+% pure mixtures of 2- and 3-sulfated materials (up to 10% sodium sulfate is typically present) and are white, non-tacky, apparently crystalline, solids. Some 2,3-disulfates may also be present, but generally comprise no more than 5% of the mixture of secondary (2,3) alkyl mono-sulfates.

If still further increases in the solubility of the "crystalline" SAS surfactants are desired, the formulator may wish to employ mixtures of such surfactants having a mixture of alkyl chain lengths. Thus, a mixture of $C_{12}$–$C_{18}$ alkyl chains will provide an increase in solubility over an SAS wherein the alkyl chain is, say, entirely $C_{16}$. This additional increase in solubility is in addition to the increase provided by the processing aspects of the present invention.

When formulating detergent compositions using the soluble particles provided by this invention, it may be desirable that the SAS surfactants contain less than about 3% sodium sulfate, preferably less than about 1% sodium sulfate. In and of itself, sodium sulfate is an innocuous material. However, it provides no cleaning function in the compositions and may constitute a load on the system when dense granules are being formulated.

Various means can be used to lower the sodium sulfate content of the SAS. For example, when the $H_2SO_4$ addition to the olefin is completed, care can be taken to remove unreacted $H_2SO_4$ before the acid form of the SAS is neutralized. In another method, the sodium salt form of the SAS which contains sodium sulfate can be rinsed with water at a temperature near or below the Krafft temperature of the sodium SAS. This will remove $Na_2SO_4$ with only minimal loss of the desired, purified sodium SAS. Of course, both procedures can be used, the first as a preneutralization step and the second as a post-neutralization step.

The term "Krafft temperature" as used herein is a term of art which is well-known to workers in the field of surfactant sciences. Krafft temperature is described by K. Shinoda in the text "Principles of Solution and Solubility", translation in collaboration with Paul Becher, published by Marcel Dekker, Inc. 1978 at pages 160–161. Stated succinctly, the solubility of a surface active agent in water increases rather slowly with temperature up to that point, i.e., the Krafft temperature, at which the solubility evidences an extremely rapid rise. At a temperature approximately 4° C. above the Krafft temperature a solution of almost any composition becomes a homogeneous phase. In general, the Krafft temperature of any given type of surfactant, such as the SAS herein which comprises an anionic hydrophilic sulfate group and a hydrophobic hydrocarbyl group, will vary with the chain length of the hydrocarbyl group. This is due to the change in water solubility with the variation in the hydrophobic portion of the surfactant molecule.

The formulator may optionally wash the SAS surfactant which is contaminated with sodium sulfate with water at a temperature that is no higher than the Krafft temperature, and which is preferably lower than the Krafft temperature, for the particular SAS being washed. This allows the sodium sulfate to be dissolved and removed with the wash water, while keeping losses of the SAS into the wash water to a minimum.

Under circumstances where the SAS surfactant herein comprises a mixture of alkyl chain lengths, it will be appreciated that the Krafft temperature will not be a single point but, rather, will be denoted as a "Krafft boundary". Such matters are well-known to those skilled in the science of surfactant/solution measurements. In any event, for such mixtures of SAS, it is preferred to conduct the optional sodium sulfate removal operation at a temperature which is below the Krafft boundary, and preferably below the Krafft temperature of the shortest chain-length surfactant present in such mixtures, since this avoids excessive losses of SAS to the wash solution. For example, for $C_{16}$ secondary sodium alkyl (2,3) sulfate surfactants, it is preferred to conduct the washing operation at temperatures below about 30° C., preferably below about 20° C. It will be appreciated that changes in the cations will change the preferred temperatures for washing the SAS surfactants, due to changes in the Krafft temperature.

The washing process can be conducted batchwise by suspending wet or dry SAS in sufficient water to provide 10–50% solids, typically for a mixing time of at least 10 minutes at about 22° C. (for a $C_{16}$ SAS), followed by pressure filtration. In a preferred mode, the slurry will comprise somewhat less than 35% solids, inasmuch as such slurries are free-flowing and amenable to agitation during the washing process. As an additional benefit, the washing process also reduces the levels of organic contaminants which comprise the random secondary alkyl sulfates noted above.

SAS Processing

On a pilot plant or commercial scale, the SAS particle manufacture in the manner of this invention can be conducted using various pieces of commercial equipment, including such items as rotary mixers, grinders, compactors, spray-dry equipment, kneaders, blenders, extruders, and the like, which are within the scope of conventional chemical engineering processes. The following illustrates a preferred process herein, but is not intended to limit the scope of the present invention.

The following procedure describes the process to produce a high active surfactant particle which contains SAS, using pilot compactor, grinder, and Lodige mixer. The high solubility and good flow properties of the resulting SAS particles allows the incorporation of higher levels of surfactant into heavy duty granular detergents than otherwise possible. An important advantage of the present process is that it employs equipment and ingredients which are otherwise well-known and conventional to those familiar with the manufacture of detergent compositions to provide SAS particles with improved solubility. For example, the materials such as the polyacrylates which are blended with the SAS in Step (a) of the process are substantially the same as the polyacrylates listed herein under Formulation Ingredients. Accordingly, it is to be understood that such materials can be present both in the SAS particles and in the balance of the fully-formulated detergent compositions which contain the SAS particles. The same is true, for example, with the zeolite powder (or silica), the nonionic surfactants, etc., used in the subsequent steps of the process.

Step (a)

This step mixes surfactant powders and dry-form organic materials, such as organic builders, to produce a mixed powder. The surfactant powders can be different chain lengths of SAS, and can also include the blown powder from a spray drying tower, pre-processed high active alcohol sulfate flake, or soap powders. The preferred organic builders include dry powders of polyacrylates, polyacrylate/maleate copolymers and other builders, as described hereinafter. The surfactant powders and preferred powdered form organic builders are well mixed in any convenient equipment, such as a cement mixer. The surfactant level in this mixed powder is around 35–75%.

Step (b)

This step removes air from the mixed powder obtained from Step (a) using a pilot compactor unit. The mixed powder from Step (a) is continuously charged onto the top of the force feeder located at the top of the compactor rolls to produce surfactant chips out of the compactor. The rotation speeds of both the force feeder and the compactor rolls and roll pressure should be adjusted to produce surfactant chips with a density of about 1000–1700 g/L. The surfactant level in the chips remains about 35 to about 75%, by weight.

Step (c)

This step grinds the surfactant chips from Step (b) to produce the desired particle sizes. The surfactant chips obtained from Step (b) are constantly fed into a pilot grinder (Fitz mill). The size of screen under the grinder, the rotation speed of grinder, and the feed rate are adjusted to obtain a targeted mean particle size of about 300–800 microns. The bulk density of these ground granules is typically greater than about 600 g/L.

Step (d)

The purpose of this step is to provide free flowing granules by coating with nonionic binders and dusting with zeolite particles (and/or powdered silica). The surfactant granules from Step (c) are charged into a pilot Lodige KM mixer with mixing. The coating binder comprising hot nonionic surfactant is sprayed onto the granule during mixing until there is no visible dust in the mixer. Zeolite powder and/or powdered silica is then charged into the mixer to coat the surface of wetted particles until free zeolite and/or free silica is not observed. The final particles contain about 1–10% by weight of nonionic binder and about 3–12% by weight of zeolite or silica.

Step (e)

The final sizing is done by sieving through appropriate screens. The final particle has a total surfactant level of >55%, a bulk density of more than about 650 g/L, and a mean particle size range of about 300–1500 microns.

The particles thus produced can be dry-blended with other detersive and/or aesthetic ingredients, as disclosed hereinafter, to provide fully-formulated granular detergent compositions. Alternatively, various optional ingredients such as soil release polymers and powdered form dye transfer inhibitors, i.e., PVP or PVNO, can be added in Step (a) and/or (d). Layered silicate particles (SKS-6) can be added in Step (a) and/or in Step (c) and (d). Liquid solutions of dye transfer inhibitor can be sprayed onto the granule of Step (d) before the nonionic binder is sprayed on. Brighteners can be pre-mixed in nonionic surfactants before Step (d). Liquid perfume can be sprayed on in Step (d).

In alternative modes, the type of coating nonionics in Step (d) can vary between Neodol/Dobanol 23-6.5, 45-7, 25-9, or other commonly used nonionics, i.e., alkyl polyglucosides, polyhydroxy fatty acid amides, polyethylene glycol, and the like, as disclosed hereinafter. Water can be used as the coating binder instead of the nonionic binder, if desired.

The sieve size in Step (e) can vary, depending on the desired appearance of the final agglomerate, the dissolution rate, and/or yield of final agglomerate. The preferred sieve size is slightly larger than about 1000 micrometers.

This process equipment is variable. Twin Screw Extruders, combinations of Kneader and Extruder, High Speed Vertical Mixers such as the Fukae Hi-speed Mixer IIL, horizontal mixers, and the like, can be used herein.

Dissolution of the SAS particles prepared in the manner of this invention can be assessed by any convenient means, without undue experimentation. For example, the SAS particles can be placed in water for incremental periods of time, and their rate of dissolution measured by titrating the amount of dissolved SAS.

In a practical method which approximates what might be seen by the consumer, the deposition of undissolved SAS particles on fabric is measured. In this method, the SAS particles are first riffled to ensure sample homogeneity. 1.5 grams of the particles are weighed out. An aliquot of water (typically, 1 liter of medium hardness city water) is equilibrated at any desired test temperature (conveniently room temperature ca. 20° C.). The SAS particles are added to a Terg-O-Tometer first before pouring in the one liter water. Four to five samples can be run in the same run.

The SAS particles are agitated for 10 minutes at 50 rpm in the Terg-O-Tometer. At the end of agitation period, the entire contents are poured onto a 90 mm Büchner funnel covered with a black test fabric, "C70", available from EMC, using standard suction filtration by water aspirator vacuum. The Terg-O-Tometer is rinsed with 500 ml of additional water with the same hardness and temperature and poured through the fabric on the Büchner funnel.

After filtration, the black fabric is dried in an oven with a setting of 49° C. to 60° C. The appearance of the fabric is then visually graded on a 1–10 scale, 10 being the worst, i.e., with the most insoluble SAS particles on the fabric, while a grade of 1 is the best.

If desired, a confirming test can be run. In this test, the solution from the Terg-O-Tometer is filtered through a 1 micron cellulose filter with vacuum. The resulting solution is then titrated for anionic surfactant concentration, using the industry standard 2-phase, Hyamine®/mixed indicator method. Hyamine is available from Sigma Chemical Company.

In an alternate mode, the so-called "cat-$SO_3$" titration method can be used. In this technique, samples of the aqueous laundering liquor containing the SAS (or fully-formulated SAS detergent composition) can be taken after one minute and filtered through a 1 micron cellulose filter, after which the filtered solution is titrated with Hyamine in the presence of anionic indicator dyes, as noted above. The amount of SAS dissolved in the aqueous liquor is thereby determined.

SAS particles prepared by the process of the present invention exhibit improved solubility, i.e., a 10 minute solubility in water which is typically about 4× to about 6× greater than unprocessed SAS particles, especially at cold (ca 5° C.) or cool (15° C.–45° C.) wash temperatures. Said another way, the SAS particles herein are at least about 70%, typically from about 90% to about 100%, dissolved in cold or cool water in about 10 minutes, as compared with unprocessed SAS particles which are only about 20%–30% dissolved under the same conditions.

Formulation Ingredients

The fully-formulated granular detergent compositions which are prepared using the SAS particles of this invention will typically comprise various other formulation ingredients to provide auxiliary cleaning and fabric care benefits, aesthetic benefits and processing aids. The following are non-limiting examples of such ingredients which are typical for use in the commercial practice of the present invention, especially to provide high quality fabric laundry detergent compositions.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot_yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions. Aluminosilicate builders include those having the empirical formula:

$$M_z(AlO_2)_y]xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May. 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid ("NTA"), as well as polycarboxylates such as mellitic acid, succinic acid, oxydisuccinic acid, polymaleic acid, benzene 1,3,5-tricarboxylic acid, carboxymethyloxysuccinic acid, and soluble salts thereof Citrate builders can be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Enzymes

Enzymes can be included in the formulations herein for a wide variety of fabric laundering purposes, including removal of protein-based, carbohydrate-based, or triglyceride-based stains, for example, and for the prevention of fugitive dye transfer, and for fabric restoration. Such enzymes include proteases, amylases, lipases, cellulases, and peroxidases, as well as mixtures thereof Other types of enzymes may also be included. They may be of any suitable orgin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–3% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g.

*Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli.* The LIPOLASE enzyme derived from *Humicola lanuginosa*and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Enzyme Stabilizers

The enzymes employed herein may be stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents will comprise from about 1 to about 30, preferably from about 2 to about 20, more preferably from about 5 to about 15, and most preferably from about 8 to about 12, millimoles of calcium ion per kg of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per kg, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Bleaching Compounds—Bleaching Agents and Bleach Activators

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof Suitable examples of this class of agents include magnesium monoperoxyphthalate hexahydrate, the magnesium salt of metachloro perbenzoic acid, 4-nonyamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Bums et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

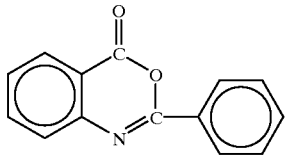

Still another class of preferred bleach activators includes the acyl lactam activators, especially acyl caprolactams and acyl valerolactams of the formulae:

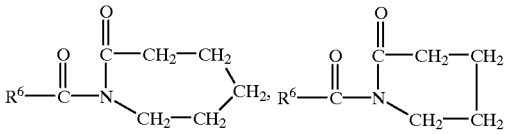

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactarn, undecenoyl caprolactam, benzoyl valerolactam, octanoyl valerolactam decanoyl valerolactam, undecenoyl valerolactam, nonanoyl valerolactam, 3,5,5-trimethylhexanoyl valerolactam and mixtures thereof See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. Nos. 5,246,621, 5,244,594; 5,194,416; 5,114,606; and European Pat. App. Pub. Nos. 549,271A1, 549,272A1, 544,440A2, and 544,490A1; Preferred examples of these catalysts include $Mn^{IV}_2(u\text{-}O)_3$(1,4,7-trimethyl-1,4,7-triazacyclononane)$_2(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. Nos. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May. 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from DuPont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

If utilized, soil release agents will generally comprise from about 0.01% to about 10.0%, by weight, of the detergent compositions herein, typically from about 0.1% to about 5%, preferably from about 0.2% to about 3.0%.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyarnine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

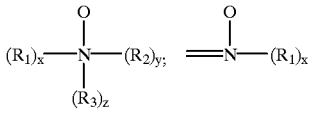

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000 ; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1 These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10.000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

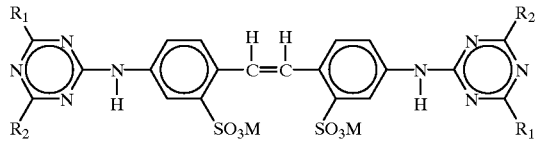

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stibenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetate, N-hydroxyethylethylenediaminetriacetates, nitrilotriacetates (NTA), ethylenediamine tetraproprionates, triethylenetetraaminehexacetates, diethylenetriaminepentaacetates (DTPA), and ethanoldiglycines, alkali metal, ammonium, and substituted amnmonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May. 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Anti-redeposition Agents

The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or antiredeposition agents known in the art can also be utilized in the compositions herein. Another type of preferred antiredeposition agent includes the carboxy methyl cellulose (CMC) materials. These materials are well known in the art.

Suds Suppressors

Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g. K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May. 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May. 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylenepolypropylene glycol copolymers or mixtures thereof (preferred), or polypropylene glycol. The primary silicone suds suppressor is branched/crosslinked and preferably not linear.

To illustrate this point further, laundry detergent compositions with controlled suds will optionally comprise from about 0.001 to about 1, preferably from about 0.01 to about 0.7, most preferably from about 0.05 to about 0.5, weight 30% of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. Nos. 4,978,471, Starch, issued Dec. 18, 1990, and U.S. Pat. No. 4,983,316, Starch, issued Jan. 8, 1991, U.S. Pat. No. 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol +silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2–3% by weight of the finished compositions.

Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

Detersive Surfactants

Nonlimiting examples of surfactants which can be used herein in addition to the SAS particles, typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Other Ingredients

A wide variety of other ingredients useful in detergent compositions can be included in the compositions herein, including other active ingredients, carriers, processing aids, dyes or pigments, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzymne solution containing 3%–5% of $C_{13}$–$C_{15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents.

The detergent compositions herein will preferably be formulated such that, during use in aqueous cleaning operations, the wash water will have a pH of between about 6.5 and about 11, preferably between about 7.5 and 11.0. Fabric laundry products are typically at pH 9–11. Techniques for controlling pH at recommended usage levels include the use of buffers, alkalis, acids, etc., and are well known to those skilled in the art.

The following Examples illustrate the preparation of soluble SAS particles and their formulation into detergent compositions, but is not intended to be limiting thereof.

EXAMPLE I

Step (a)

This step mixes the surfactant powders such as 95% active Secondary Alkyl Sulfate (SAS) C16 powder, 39% active of the blown surfactant powder from the spray drying tower, 85% active pre-processed alcohol sulfate flake, 99% active soap powder and 94% active dry form organic builders (copolymers). The batch scale is a 20 kg/batch as the mixed material. Fill level is 40% in accordance with the assumed bulk density of mixed powder of 450 g/L. 3.97 kg of SAS C16, 7.24 kg of blown surfactant powder, 5.08 kg of alcohol sulfate flake, 1.44 kg of soap powder and 2.09 kg of powdered form organic builder are well mixed in a cement mixer (60 liters capacity) for 2 minutes. The surfactant level in this powder is ~62%.

Step (b)

This step removes air from the mixed powder obtained from Step (a) using a pilot compactor unit; Compacting Machine BCS25-063 available from SINTO KOGIO, LTD. The mixed powder from Step (a) is continuously loaded onto the top of the force feeder that is located at the top of the compactor rolls in order to produce surfactant chips out of the compactor. Pilot compactor unit operation conditions are: rotation speed of rolls is 3.58 rpm; power is measured in Amperes and indicates 6.0~6.5 roll Amperes ; roll pressure is 1.3~1.7 tons; rotation speed of force feeder is 26~28 rpm; and indicates amperes of force feeder at 4.0~5.2. The compaction rate is ~55 kg/hr as chips. Chip density coming out is 1.2~1.4 g/cc. The surfactant level in the chips remains ~62%.

Step (c)

This step grinds the surfactant chips from Step (b) to produce desired particle sizes. The surfactant chips obtained from Step (b) are constantly fed into a pilot grinder (Fitz mill). Pilot grinder operation conditions are: the rotation speed of shaft is ~4650 rpm; indicates the shaft amperes at 5.0~7.0; a 1.5 mm punch out size screen is used. Percent of on 850 $\mu$m of the ground chips is 2.5~4.0%. Percent of under 150 $\mu$m is 20~30%. The bulk density of these ground chips is ~660 g/L as ground. The surfactant level in these ground granules remains ~62%.

Step (d)

This step provides free flowing granules by coating with nonionic binder and dusting with zeolite particles and hydrophobic precipitated silica. The surfactant granules from Step (c) are loaded into a pilot Lödige KM mixer (50 liters capacity). Batch scale of coating is 13 kg/batch as coated accepts. Fill level is 40% in accordance with the assumed bulk density of coated accepts of 650 g/L. The blade speed is 35 rpm and the chopper speed is 3000 rpm. At the first step, 40 g of PVP is sprayed into the Lödige mixer during 25~30 sec. The premixed 10 g of Tinopal® AMS-GX brightener and 30 g of Tinopal® CBS-X brightener in 560 g of nonionic 45–7 is sprayed into the Lödige mixer. The temperature of this mixture is heated to −70° C. 800~1400 g of zeolite and 140 g of soil release polymers are added/mixed into the Lödige mixer during 200 sec. Then, 60 g of perfume (MWII) is sprayed into the mixer during 30~40 sec. As the final step, 100 g of hydrophobic precipitated silica is mixed during 70 sec. The surfactant level of these coated particles is ~56%.

Step (e)

This step sieves the coated accepts from Step (d) by using a pilot sieving unit. The screen size of this pilot sieving unit is 1180 $\mu$m. The sieved coated particles have a total surfactant level of ~56%. The bulk density, cake strength and cake compression are ~700 g/L, 0.7 kg and 4.9 mm, respectively, as sieved.

To provide a detergent base granule, the SAS particles are dry mixed with materials such as sodium perborate monohydrate, NOBS, SKS-6, protease, speckles and carbonate. Batch scale of dry mixing is 30 kg/batch as finished product, using a cement mixer (60 liters capacity). The mixing time is 2 minutes. The surfactant level of finished product is ~38%. The bulk density, cake strength and cake compression are ~780 g/L, 0.3 kg and 4.0 mm, respectively, as of 1 day after manufacture.

The following illustrates free-flowing SAS particles which are prepared by the process of this invention with the indicated ingredients.

In Example II, the ingredient abbreviations refer to the following materials: SAS (C16) is a secondary (2,3) alkyl sulfate surfactant with an average of 16 carbon atoms; AS (C14–15) is primary alkyl sulfate surfactant with an average of 14–15 carbon atoms; AE (C45–7) is an alcohol ethoxylate surfactant having an average of 14–15 carbon atoms and an average of 7 ethoxy units; LAS (C12) is an alkyl benzene sulfonate surfactant with an average of 12 carbon atoms in the alkyl chain; Metolose is the trade name of methyl cellulose ethers manufactured by Shin-etsu Kagaku Kogyo K.K., and is available as Metolose SM15, SM100, SM200 and SM400, all of which are useful herein; the hydrophobic silica has a particle size in the range of from about 1 to about 5 microns, and is available as SIPERNAT D10 from DeGussa; the Zeolite A has a particle size in the 0.5–10 micrometer range; the polyacrylate has a molecular weight in the range from about 2000 to about 6000; the hydroxyethyl monoalkyl quat is hydroxyethyl dodecyl dimethyl ammonium chloride; the balance of the abbreviated ingredients are as defined hereinabove.

EXAMPLE II

| Ingredient | % Total Formulation (wt.) |
|---|---|
| Surfactant Particle | |
| SAS(C16) | 15.5 |
| AS(C14-15) | 18.4 |
| AE(C45-7) | 4.4 |
| LAS(C12) | 11.1 |
| Hydroxyethylmonoalkyl quat | 0.2 |
| Tallow soap | 5.9 |
| | 55.5 |
| Builder/Alkalinity | |
| SKS-6 | 4.7 |
| Polyacrylate | 11.0 |
| Zeolite A* | 9.2 |
| PEG 4000 | 1.9 |
| $Na_2CO_3$ | 6.5 |
| | 33.3 |
| Minors | |
| Metolose | 1.11 |
| FWA15 Tinopal AMS-GX** | 0.13 |
| FWA49 Tinopal CBS-X** | 0.29 |
| Hydrophobic silica | 0.83 |
| PVP | 0.10 |
| Perfume | 0.44 |
| Moisture | 4.6 |
| Misc. | 3.7 |
| | 11.2 |
| TOTAL | 100.0 |
| Physical Properties | |
| Density(g/L) | 696 |
| Mean Particle Size (microns) | 500 |

*Includes coating on SAS/surfactant particles.
**Optical Brighteners

The foregoing detergent composition is free-flowing, has quite acceptable dusting and caking grades, and is intended for use even under cold wash conditions.

Examples III–X, hereinafter, illustrate detergent compositions using the SAS particles prepared in the manner of the present invention. In these Examples, the overall weight percentage of the ingredients is listed in the vertical columns.

EXAMPLE III–X

| Ingredient* | III | IV | V | VI | VII | VIII | IX | X |
|---|---|---|---|---|---|---|---|---|
| Surfactants | | | | | | | | |
| C16 SAS | 15.5 | 8 | 8 | 8 | 16 | 10 | 5 | 7 |
| C14 SAS | 0 | 8 | 0 | 8 | 0 | 10 | 5 | 10 |
| C18 SAS | 0 | 5 | 7 | 0 | 0 | 0 | 5 | 0 |
| C45 AS | 18.4 | 0 | 0 | 10 | 10 | 0 | 5 | 0 |

-continued

| Ingredient* | EXAMPLE III–X | | | | | | | |
|---|---|---|---|---|---|---|---|---|
| | III | IV | V | VI | VII | VIII | IX | X |
| C45 AExS | 0 | 0 | 3 | 0 | 0 | 0 | 0 | 0 |
| Coconut AS | 0 | 8 | 0 | 0 | 0 | 0 | 0 | 0 |
| C12 LAS | 11.1 | 0 | 7 | 0 | 11 | 10 | 0 | 0 |
| C13 LAS | 0 | 0 | 5 | 0 | 0 | 0 | 5 | 0 |
| C46 AOS | 0 | 0 | 0 | 5 | 0 | 0 | 0 | 0 |
| C68 MES | 0 | 10 | 0 | 5 | 0 | 0 | 10 | 15 |
| C46 AGS | 0 | 0 | 3 | 0 | 0 | 5 | 5 | 5 |
| Hydroxyethyl monododecyl quat | 1 | 0 | 0.5 | 0 | 1 | 0 | 1 | 1 |
| Trimethyl alkyl quat | 0 | 1 | 0 | 0 | 0 | 0 | 0 | 0 |
| Tallow soap | 5 | 3 | 0 | 0 | 6 | 2 | 0 | 2 |
| Coconut soap | 0 | 2 | 0 | 0 | 0 | 0 | 0 | 0 |
| Oleate soap | 0 | 4 | 4 | 3 | 0 | 0 | 4 | 0 |
| Neodol C45 E7 | 4 | 0 | 0 | 2 | 4.4 | 0 | 2 | 4 |
| Neodol C23 E6.5 | 0 | 0 | 0 | 0 | 0 | 2 | 0 | 0 |
| Neodol C25 E9 | 0 | 2.5 | 2 | 0 | 0 | 0 | 0 | 0 |
| Coconut acyl glucamide | 0 | 0 | 3 | 5 | 0 | 3 | 3 | 0 |
| Acyl monoethanolamide | 0 | 0 | 2 | 0 | 0 | 0 | 0 | 0 |
| Acyl diethanolamide | 0 | 0 | 0 | 2 | 0 | 0 | 0 | 0 |
| Salts/Builder | | | | | | | | |
| Layered silicate | 4 | 0 | 0 | 15 | 5 | 0 | 18 | 20 |
| Zeolite A | 9 | 10 | 0 | 10 | 5 | 0 | 5 | 10 |
| Zeolite X | 0 | 0 | 15 | 0 | 0 | 7 | 0 | 0 |
| Polyacrylate Na | 8 | 0 | 10 | 0 | 2 | 1 | 0 | 5 |
| Copolymer of acrylate/maleate | 0 | 12 | 0 | 0 | 0 | 3 | 5 | 0 |
| NTA | 0 | 0 | 0 | 0 | 5 | 0 | 0 | 0 |
| STP | 0 | 0 | 0 | 0 | 5 | 20 | 0 | 0 |
| PEG 4000 | 1.9 | 0 | 1 | 2 | 1 | 1 | 2 | 2 |
| Soda Ash | 5 | 7 | 15 | 8 | 10 | 12 | 9 | 9 |
| Powdered hydrophobic silica | 0.5 | 1 | 0 | 1 | 0.8 | 1 | 1 | 1 |
| Sodium perborate | 4 | 0 | 0 | 0 | 0 | 0 | 0 | 0 |
| Sodium percarbonate | 0 | 5 | 0 | 0 | 5 | 0 | 0 | 0 |
| NOBS | 4.5 | 2 | 0 | 0 | 5 | 0 | 0 | 0 |
| TAED | 0 | 3 | 0 | 0 | 0 | 0 | 0 | 0 |
| Sodium sulfate | 1 | 3 | 5 | 8 | 2 | 5 | 2 | 3 |
| DTPA | 0.5 | 0 | 0 | 0 | 0 | 0 | 0 | 0 |
| EDDS | 0 | 0 | 1 | 0 | 0 | 0 | 0 | 0 |
| EDTA | 0 | 0 | 0 | 1 | 0 | 0 | 0 | 0 |
| Others | | | | | | | | |
| Perfume | 0.3 | 0.3 | 0.3 | 0.2 | 0.2 | 0.2 | 0.3 | 0.2 |
| Soil release polymers | 1 | 0 | 0 | 0 | 1 | 0 | 1 | 1 |
| Brighteners | 0.4 | 0.3 | 0.4 | 0 | 0.5 | 0.4 | 0.6 | 0.3 |
| Polyvinyl Alcohol or PVNO | 0.1 | 0 | 0 | 2 | 0 | 0 | 0 | 0.2 |
| Moisture | Balance | | | | | | | |
| Total: | 100 | 100 | 100 | 100 | 100 | 100 | 100 | 100 |

In the Examples III–X, the abbreviations used for the Ingredients appear hereinabove in the listing of Formulation Ingredients, or are as defined hereinafter.

C45AExS is $C_{14}$–$C_{15}$ alcohol ethoxylate (1–3) sulfate.

C46AOS is $C_{14}$–$C_{16}$ alpha olefin sulfonate.

C68MES is $C_{16}$–$C_{18}$ methyl ester sulfonate.

C46AGS is $C_{14}$–$C_{16}$ alkyl glycerol sulfate.

Hydroxyethyl monododecyl quat is hydroxyethyl dodecyl dimethyl ammonium chloride.

Trimethyl alkyl quat is dodecyl trimethyl ammonium chloride.

The NEODOLS are commercial nonionic surfactants.

Coconut acyl glucamide is coconutalkyl N-methyl glucamide.

Acyl monoethanolamide is coconutalkyl monoethanolamide.

Acyl diethanolamide is coconutalkyl diethanolamide.

Layered silicate is SKS-6.

Polyacrylate, Na has a molecular weight of 2000–6000.

Copolymer of acrylate/maleate has a molecular weight of 2000–20,000.

STP is sodium tripolyphosphate.

Soil release polymer is an anionic polyester; see Gosselink patents cited above.

Metolose, noted above, can be used.

Brighteners are TINOPALS®, available from Ciba-Geigy.

The foregoing compositions are prepared by dry-blending the SAS particles herein with the balance of the ingredients. The compositions are used as fabric laundry detergents, at conventional usage ranges from about 500 ppm to 50,000 ppm in aqueous media. The compositions exhibit excellent cleaning performance and improved solubility, especially in compositions where the size of the SAS particles (i.e., largest diameter of the particles) is in the 100–2000 micrometer range. The $C_{16}$SAS is especially preferred.

What is claimed is:

1. A process for preparing particles of secondary (2,3) ally sulfate surfactants with improved solubility, comprising the steps of:

(a) admixing said secondary (2,3) alkyl sulfate in particulate form with a water-soluble particulate organic material selected from the group consisting of polyacrylates, acrylate/maleate copolymers, and mixtures thereof to provide a substantially homogeneous powder mixture containing at least about 10%, by weight, of said secondary (2,3) alkyl sulfate;

(b) compacting said powder mixture from step (a) into chips;

(c) comminuting the chips from step (b) into particles having a size in the range from about 100 to about 2000 micrometers and a density of at least about 500 g/L;

(d) coating said particles from step (c) with a nonionic surfactant binder, and thereafter, coating said particles with a free-flow aid to provide free-flowing particles;

(e) optionally, sizing the coated particles of step (d) to a mean particle size in the range from about 100 to about 1500 micrometers.

2. A process according to claim 1 wherein the homogeneous powder mixture of step (a) comprises from about 10% to about 75%, by weight, of the secondary (2,3) alkyl sulfate surfactant.

3. A process according to claim 1, wherein the chips of step (b) have a density in the range from about 1000 g/L to about 1700 g/L.

4. A process according to claim 1 wherein the density of the particles of step (c) is at least about 550 g/L.

5. A process according to claim 1 wherein the free-flow aid in step (d) is a member selected from the group consisting of finely powdered zeolite, finely powdered silica, and mixtures thereof.

6. A process according to claim 1 wherein the particles of step (d) comprise from about 1% to about 10%, by weight, of the nonionic binder and from about 3% to about 12%, by weight, of the free-flow aid.

7. A granular detergent composition, comprising builders and at least about 5%, by weight, of the particles prepared according to the process of claim 1.

8. A granular detergent composition, comprising builders and from about 10% to about 99%, by weight, of the particles prepared according to claim 7.

* * * * *